US007568952B2

(12) United States Patent
Long et al.

(10) Patent No.: US 7,568,952 B2
(45) Date of Patent: Aug. 4, 2009

(54) ELECTRICAL CARD CONNECTOR WITH PRESSING PLATE HAVING ROUNDED EDGE TO AVOID DAMAGING INSERTED CARD

(75) Inventors: Ji-En Long, ShenZhen (CN); Wei-Nan Kuo, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/009,812

(22) Filed: Jan. 22, 2008

(65) Prior Publication Data

US 2008/0176450 A1 Jul. 24, 2008

(51) Int. Cl.
*H01R 24/00* (2006.01)

(52) U.S. Cl. ..... 439/630

(58) Field of Classification Search ..... 439/64, 439/630, 377, 32, 326, 327
See application file for complete search history.

(56) References Cited

U.S. PATENT DOCUMENTS 5,813,878 A * 9/1998 Kuwata et al. ..... 439/326
6,175,505 B1 * 1/2001 Cheng et al. ..... 361/752
6,210,193 B1 * 4/2001 Ito et al. ..... 439/326
6,319,036 B1 * 11/2001 Zheng et al. ..... 439/326
6,881,086 B2 * 4/2005 Ohashi ..... 439/326
7,056,153 B2 * 6/2006 Watanabe et al. ..... 439/630
7,112,075 B1 * 9/2006 Su ..... 439/159
7,329,146 B2 * 2/2008 Yang et al. ..... 439/570
2005/0239333 A1 * 10/2005 Watanabe et al. ..... 439/630

* cited by examiner

*Primary Examiner*—T C Patel
*Assistant Examiner*—Harshad C Patel
(74) *Attorney, Agent, or Firm*—Wei Te Chung

(57) ABSTRACT

Provided herewith an electrical card connector includes an insulative housing defining a front portion and a rear portion with a mating interface extending therebetween. A plurality of contact is received in the housing and having their contact engaging portion extends above the mating interface. The insulative housing further defines sides between the front and rear portions. A pair of metallic positioning devices each is attached to a corresponding side of the housing, and includes a vertical portion defining a sidewall of the housing, and a top portion extending from the sidewall toward each other. A receiving space is jointly defined by the mating interface, the sidewalls, and the top portions. The top portion has rounded portion running along edges thereof.

7 Claims, 4 Drawing Sheets

ELECTRICAL CARD CONNECTOR WITH PRESSING PLATE HAVING ROUNDED EDGE TO AVOID DAMAGING INSERTED CARD

BACKGROUND OF THE INVENTION

1. Field of the Invention

The present invention relates to card connectors, especially to a card connector having pressing plate with rounded edge on a pressing plate so as to prevent the inserted SIM card from being damaged.

2. Background of the Invention

Electrical cards are known in the art and contain artificial intelligence in the form of a memory circuit or other electronic program. Some form of card reader retrieves the information or data stored on the card. Such cards are used in many applications in today's electronic society, including video cameras, digital still cameras, smart phones, PDAs, music players, ATMs, cable television decoders, toys, games, PC adapters, multi-media cards and other electronic applications.

Examples of prior art card-receiving connectors generally comprise a housing having contacts mounted therein. The housing includes a main body which defines a plurality of passageways, a rear wall and a pair of sidewalls extending forwards from two opposite sides of the main body. The rear wall and the sidewalls define a receiving cavity for receiving an electrical card therein and the inner sides of the sidewalls define a recess respectively. The contacts have contact portions, which extend above the surface of the insulative housing to contact corresponding contacts on a card. A pair of hooks are hinged or pivotally mounted to the housing. A card, such as a "SIM" card, is inserted into a card-receiving section formed in the hooks. The card contacts are forced against the contact portions on the housing for effecting an electrical connection between the circuitry of the card and the connector. A reliable connection can be retained by the hooks.

Unfortunately, problems continue to be encountered with the electrical card connectors mentioned above. When the electrical card is inserted into the insulative housing, the front edge of the a pressing plate meet and touch the electrical card; it is easy to scar the surface of the electrical card. The present invention has a chamfered edge on the hook (a pressing plate), inserting the electrical card into the insulative housing, the chamfered edge of the hooks meet and touch the electrical card first, then the electrical card can enter the card-receiving section overall, this kind of configuration can reduce probability of scaring, and make the inserting more smoothly. Therefore, an improved electrical card connector is desired to overcome the disadvantages of the prior arts.

SUMMARY OF THE INVENTION

An object, therefore, of the invention is to provide a new and improved electrical card connector of the character described able to prevent the electrical card therein from scaring.

In order to achieve the objects set forth above, an electrical card connector made in accordance with the present invention includes an insulative housing defining a front portion and a rear portion with a mating interface extending therebetween. A plurality of contact is received in the housing and having their contact engaging portion extends above the mating interface. The insulative housing further defines sides between the front and rear portions. A pair of metallic positioning devices each is attached to a corresponding side of the housing, and includes a vertical portion defining a sidewall of the housing, and a top portion extending from the sidewall toward each other. A receiving space is jointly defined by the mating interface, the sidewalls, and the top portions. The top portion has rounded portion running along edges thereof.

According to one aspect of the present invention, the outer edges of the metallic positioning devices are in the form of smooth step-shape and the top portion has rounded portion running along edges, these features can help to prevent the electrical card from scaring.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
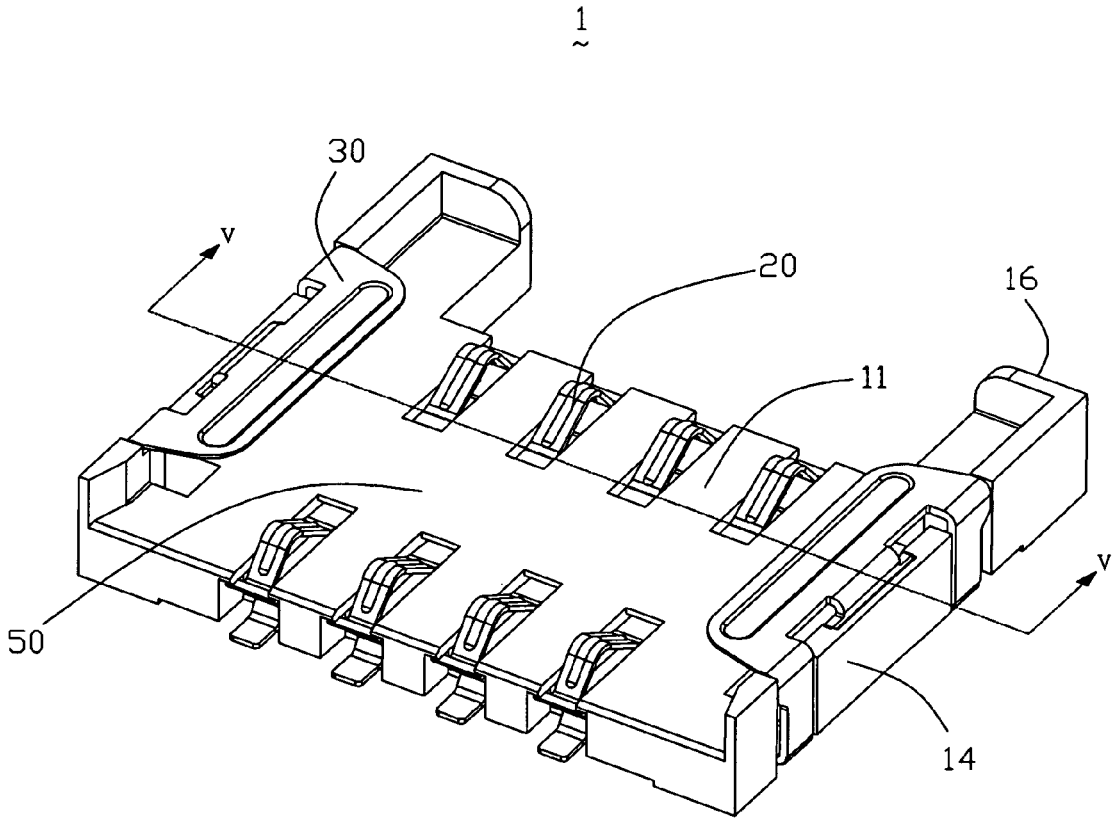
FIG. 1 is an assembled perspective view of an electrical card connector embodying the concepts of the invention.
Figure 2:
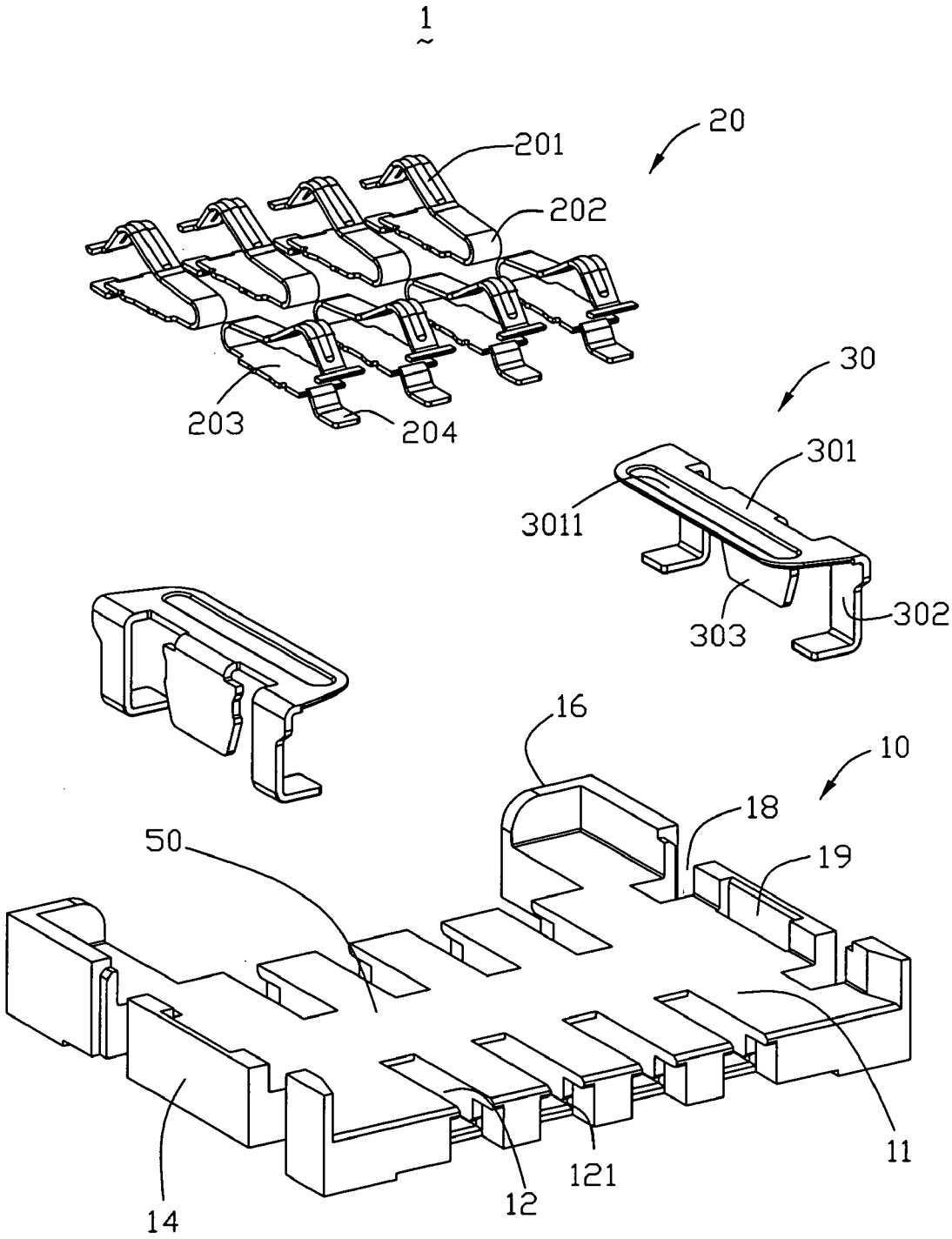
FIG. 2 is an exploded view of the electrical card connector shown in FIG. 1.
Figure 5:
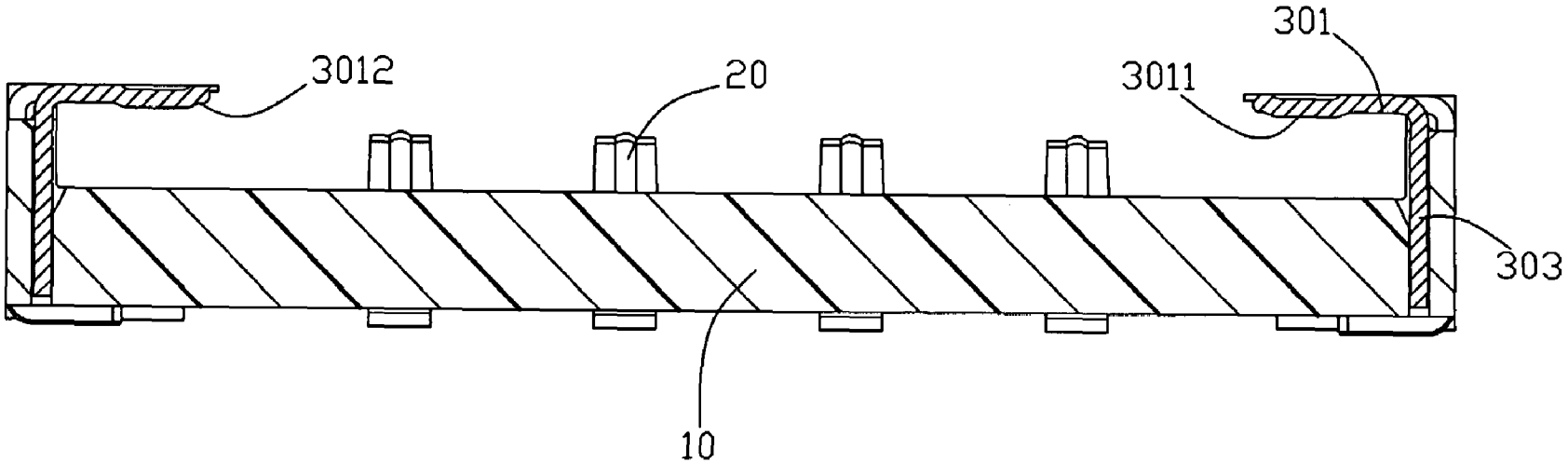
FIG. 5 is a cross-sectional view of the electrical card connector shown in FIG. 1.

Referring to FIGS. 1-2, an electrical card connector 1, which connect a card (not shown) to a circuit board (not shown) in accordance with the preferred embodiment of the present invention comprises an insulative housing 10, a plurality of contacts 20 received in the insulative housing 10, a pair of metallic positioning devices 30 engages with the two opposite sidewalls 14. The pair of metallic positioning devices 30 defines a receiving cavity 50, which receives electrical card together with the insulative housing 10. See FIG. 5 also.

The insulative housing 10 comprises a main body 11, a pair of sidewalls 14, a front portion (not labeled) and a rear potion 16 which is opposite to the front portion. The main body 11 is in the form of general flat rectangular body, the sidewalls 14, the front portion and the rear potion 16 extend upwardly from the edges of the main body 11 therein and a mating interface (not labeled) is defined therebetween. A plurality of passageways 12 which having slot portions 121 for receiving contacts 20 are disposed on the two opposite side of main body 11 therein. Each sidewall 14 defines a notch portion 19 on the central section of the surface facing to the receiving cavity 50. On the two sides of the sidewalls' upper surface, two gap portions 18 run through from the top down.

Contacts 20 are mounted within a plurality of passageways 12 of the insulative housing 10. Each contact 20 includes a contact engaging portion 201 for contacting the printed circuit board, a retention portion 203 for helping to stabilize the contacts 20, a soldering portion 204 for soldering the contacts 20 onto the printed circuit board. The soldering portion 204 bending downwardly is defined at the end of the retention portion 203, in addition, the contact engaging portion 201 and the retention portion 203 are connected by the spring portion

202. When the contacts 20 received in the corresponding passageways 12, the two side surfaces of slot portion 121 put the pressure onto the retention portion 203 to make the engagement between the contacts 20 and the passageways 12 stable.

Figure 3:
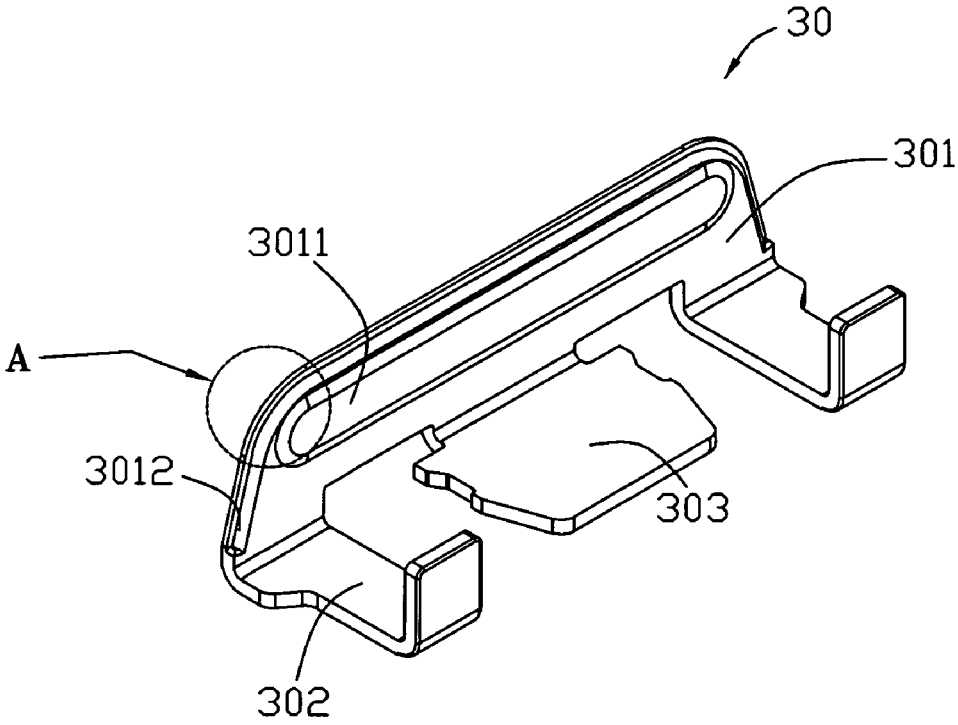
FIG. 3 is a perspective view of the hook of the electrical card connector of FIG. 1.
Figure 4:
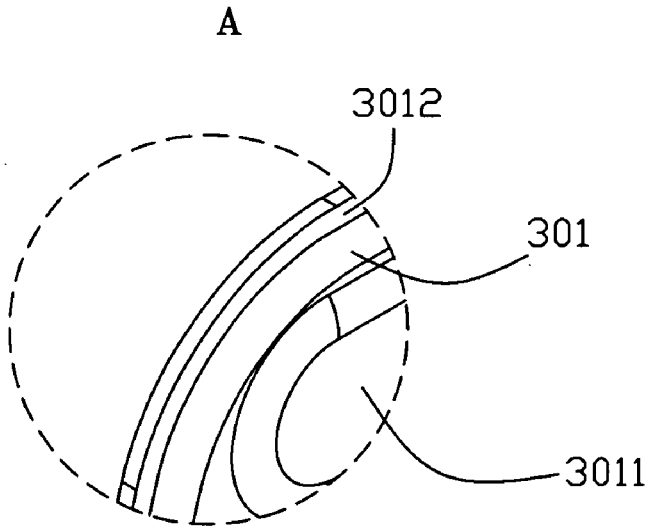
FIG. 4 is a perspective view of portion A of the hook shown in FIG. 3.

Referring to FIGS. 3-4, each metallic positioning device 30 comprises a top portion 301 with a embossed portion 3011 on the undersurface therein. The curved portion 302 is defined at the two ends of the top portion 301 and the vertical portion 303 is defined in the middle part of the top portion 301, both of the curved portion 302 and the vertical portion 303 bend and extend downwardly to cooperate with the gap portion 18 and inserted into the notch portion 19 in harmony respectively for stabilizing the metallic positioning device 30.

A cambered stepped portion 3012, which put the edge of the top portion 301 into a step-shape is defined on the surface facing to the insulative housing 10. Each of the metallic positioning device 30 is configured to have a rounded edge facing toward the mounting surface of the housing 10. The two opposite ends of the top portion 301 are R-shaped (not labeled) so as to provide a smooth lead-in. During the course of inserting an electrical card into the receiving cavity 50, the pressure (resistance) on the electrical card is largely dispersed in the very beginning by the cambered stepped portion 3012 along the R-shaped lead-in, therefore, the electrical card can be protected through the reduction of scaring probability.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

While preferred embodiment in accordance with the present invention have been shown and described, equivalent modifications and changes known to persons skilled in the art according to the spirit of the present invention are considered within the scope of the present invention as defined in the appended claims.

What is claimed is:

1. An electrical card connector, comprising:

an insulative housing defining a front portion and a rear portion with a mating interface extending therebetween, a plurality of contact received in the housing and each having contact engaging portion extending above the mating interface, the insulative housing further defining sidewalls between the front and rear portions;

a pair of metallic positioning devices each attached to a corresponding sidewall of the housing, and including a vertical portion inserted into a notch portion of a sidewall of the housing, and a top portion extending from the sidewall toward each other and jointly defining a receiving space with the mating interface and the sidewalls; and a cambered stepped portion running along edges of the top portions.

2. The electrical card connector as claimed in claim 1, wherein the top portion's two ends are in the form of circular arc.

3. The electrical card connector as claimed in claims 1, wherein two ends of each top portion defines a pair of curved portions bending downwardly.

4. The electrical card connector as claimed in claim 1, wherein the vertical portion is disposed between the two curved portions.

5. The electrical card connector as claimed in claim 1, wherein contacts received in the insulative housing symmetrically.

6. An electrical connector comprising:

an insulative housing defining an upward mating interface with a pair of side walls extending upward by two sides of said mating interface;

a plurality of contacts disposed in the housing with contact portions extending above the mating interface, respectively;

a pair of metallic positioning devices assembled to the corresponding side walls, respectively, said positioning devices including top portions horizontally extending toward each other above the mating interface; wherein said top portion defines an edge facing to the other top portion, and said edge is formed with a downward convex toward the mating interface in a vertically cross-sectional view.

7. The electrical connector as claimed in claim 6, wherein said top portion further includes an downward embossed portion extending along a front-to-back direction and located proximate said edge.

* * * * *